US009006121B2

(12) United States Patent
Reilly et al.

(10) Patent No.: US 9,006,121 B2
(45) Date of Patent: Apr. 14, 2015

(54) CONSTRUCTION ARTICLES AND METHODS OF FORMING SAME

(71) Applicants: Christopher J. Reilly, Whitinsville, MA (US); Edmund A. Cortellini, North Brookfield, MA (US); Robin M. Harrington, Leicester, MA (US)

(72) Inventors: Christopher J. Reilly, Whitinsville, MA (US); Edmund A. Cortellini, North Brookfield, MA (US); Robin M. Harrington, Leicester, MA (US)

(73) Assignee: Saint-Gobain Ceramics & Plastics, Inc., Worcester, MA (US)

( * ) Notice: Subject to any disclaimer, the term of this patent is extended or adjusted under 35 U.S.C. 154(b) by 186 days.

(21) Appl. No.: 13/732,187

(22) Filed: Dec. 31, 2012

(65) Prior Publication Data

US 2013/0168079 A1 Jul. 4, 2013

Related U.S. Application Data

(60) Provisional application No. 61/582,060, filed on Dec. 30, 2011.

(51) Int. Cl.
*C04B 35/573* (2006.01)
*E21B 43/12* (2006.01)

(52) U.S. Cl.
CPC ..... *E21B 43/12* (2013.01)

(58) Field of Classification Search
CPC .... C04B 41/515; C04B 41/51; C04B 35/573; C04B 35/565; C04B 41/85; C04B 41/88; C03B 35/565
USPC ..... 501/88, 89, 90; 428/307.7
See application file for complete search history.

(56) References Cited

U.S. PATENT DOCUMENTS

| | | | | |
|---|---|---|---|---|
| 4,564,496 | A * | 1/1986 | Gupta et al. | 264/44 |
| 6,186,768 | B1 * | 2/2001 | Schmitt | 425/550 |
| 7,141,309 | B2 * | 11/2006 | Kinoshita et al. | 428/539.5 |
| 8,043,694 | B2 * | 10/2011 | His et al. | 428/307.7 |
| 2004/0173382 | A1 | 9/2004 | Strand et al. | |
| 2007/0056777 | A1 | 3/2007 | Overstreet | |
| 2009/0305017 | A1 * | 12/2009 | His et al. | 428/220 |
| 2010/0075160 | A1 | 3/2010 | Chaumat et al. | |
| 2011/0059276 | A1 | 3/2011 | Winkler | |
| 2012/0165179 | A1 * | 6/2012 | Reilly et al. | 501/88 |
| 2012/0181470 | A1 | 7/2012 | King et al. | |

FOREIGN PATENT DOCUMENTS

| | | | |
|---|---|---|---|
| DE | 4243864 | * | 7/1993 |
| WO | 2009137729 | A2 | 11/2009 |

OTHER PUBLICATIONS

International Search Report and Written Opinion mailed Apr. 23, 2013 with regard to international application PCT/US12/72241.

* cited by examiner

*Primary Examiner* — Karl Group
(74) *Attorney, Agent, or Firm* — Abel Law Group, LLP; Robert N. Young

(57) ABSTRACT

A pipe choke for use in drilling and mining operations comprising a body including a first end and a second end configured to couple to a pipe, an opening extending through the body from the first end to the second end, and wherein the body includes a first phase comprising recrystallized silicon carbide and a second phase comprising silicon.

14 Claims, 2 Drawing Sheets

CONSTRUCTION ARTICLES AND METHODS OF FORMING SAME

CROSS-REFERENCE TO RELATED APPLICATION

This application claims priority under 35 U.S.C. §119(e) to U.S. Patent Application No. 61/582,060 entitled "Construction Articles and Methods of Forming Same," by Reilly et al., filed Dec. 30, 2011, which is assigned to the current assignee hereof and incorporated herein by reference in its entirety.

BACKGROUND

1. Field of Disclosure

The following is directed to a construction article, and particularly, a construction article having a composite structure.

2. Description of the Related Art

Many oil well facilities around the world operate under high pressure. In other words, the pressure within the well is sufficiently high (e.g., 3000 to 5000 psi) to carry the crude oil to the surface without pumping. Unless restricted, the crude oil flows to the surface at a high velocity and contains sand and other debris that can erode some of the oil well piping components. In order to control flow properties in the pipes, pressure reducing components may be used at particular intervals. Generally, pressure reducing devices are made of carbon steel. The devices may have tungsten carbide inserts to line the inside surfaces of the flow channel to reduce erosive effects of the fluid contained therein. Continuous erosion of the pressure reducer over time typically results in continuous loss of operating pressure until gross failure requires replacement. Since high pressure oil wells typically produce about 5,000 to 12,000 barrels of oil a day, the downtime associated with replacement of a pressure reducer can result in a significant loss of oil production. It is readily apparent that the present construction of oil well pressure reducing assemblies leaves something to be desired with respect to wear resistance and useful life.

Tungsten carbide is known to be one of the most wear-resistant materials currently available. Moreover, its combination as a coating on metal materials is well-known. Tungsten carbide is applied as a coating on a metal substrate to make the material more wear-resistant while saving costs and avoiding manufacturing constraints for making monolithic bodies of tungsten carbide. Other ceramic materials commercially available include oxides and carbides. Among the carbide materials, silicon carbide has been used in the refractories industry. Various types of silicon carbide exist, including for example, sintered silicon carbide, hot pressed silicon carbide, and recrystallized silicon carbide. Generally, porous silicon carbide materials such as nitride-bonded silicon carbide (known by acronyms such as NBSC and NSIC) have found practical use in refractory applications.

SUMMARY

In one aspect, a pipe choke for use in drilling and mining operations includes a body including a first end and a second end configured to couple to a pipe, an opening extending through the body from the first end to the second end, and wherein the body includes a first phase having recrystallized silicon carbide and a second phase including silicon.

In another aspect, a construction article for use in oilfield and mining applications includes a body including a first end and a second end, an opening extending through the body from the first end to the second end, and wherein the body includes a first phase comprising silicon carbide and a second phase comprising silicon, wherein the second phase defines an essentially continuous and interconnected network of material extending throughout the volume of the first phase.

According to another aspect, an article includes a body having a first phase comprising silicon carbide and a second phase comprising silicon, wherein the first phase comprises an average grain size greater than about 200 microns, and wherein the second phase defines an essentially continuous and interconnected network of material extending throughout the volume of the first phase.

In yet another aspect, a method of forming a composite article includes providing a body comprising recrystallized silicon carbide, wherein the recrystallized silicon carbide comprises an average grain size of at least about 200 microns, and infiltrating the body with an infiltrant to form a composite body, wherein the infiltrant comprises at least about 98% silicon.

BRIEF DESCRIPTION OF THE DRAWINGS

The present disclosure may be better understood, and its numerous features and advantages made apparent to those skilled in the art by referencing the accompanying drawings.

DETAILED DESCRIPTION

The following is directed to products for use in heavy equipment industries including for example, mining, logging, oil field operations, building, construction, mass fluid transport operations, civil engineering applications, nautical engineering applications, and the like.

Figure 1:
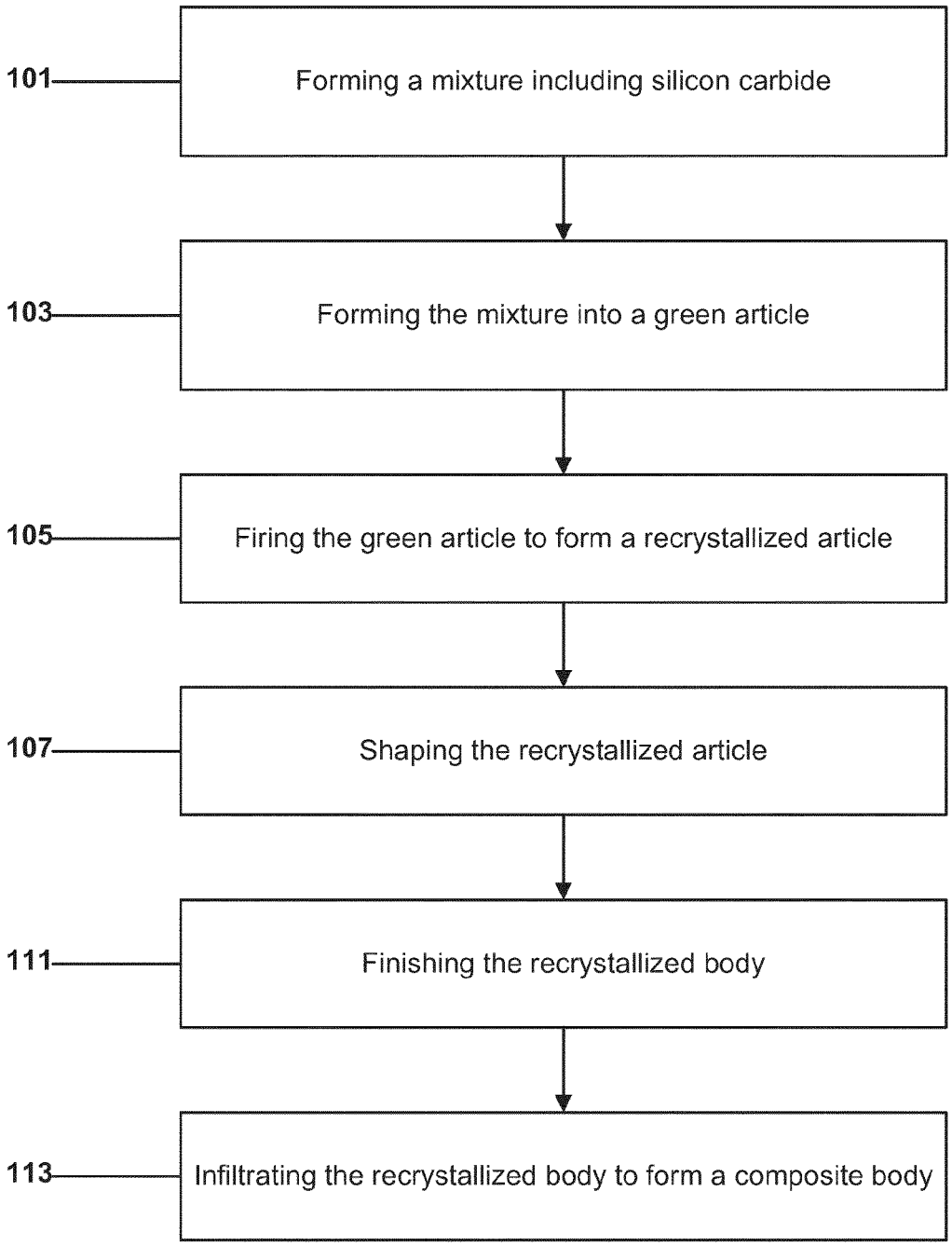
FIG. 1 includes a flow chart illustrating a method of making a composite article according to an embodiment.

FIG. 1 includes a flow chart illustrating a method of forming a composite article in accordance with an embodiment. As illustrated, the process can be initiated at step 101 which includes forming a mixture including silicon carbide. The mixture can be a dry powder mixture of silicon carbide powder materials. In other instances, it will be appreciated that the mixture can be a wet mixture utilizing powder components (e.g. silicon carbide powder) and a liquid dispersant or liquid carrier. The wet mixture can be an aqueous-based mixture utilizing water as the liquid carrier. Other liquid carriers can include other inorganic or organic liquid materials.

In accordance with an embodiment, the mixture may utilize a bimodal distribution of silicon carbide powder sizes. For example, the mixture can include a first silicon carbide powder having a fine grit size and a second silicon carbide powder having a coarse grit size, wherein the coarse powder has an average grit size that is significantly greater than the average grit size of the fine powder material. In accordance with an embodiment, the mixture can be formed such that the coarse silicon carbide powder has an average grit size that is at least 10% larger than an average grit size of the fine silicon carbide powder, wherein the percentage is based upon the smaller of the two grit sizes. The percentage difference in grit sizes can be calculated by the equation $((CP-FP)/FP)\times 100\%$, wherein CP is the average grit size of the coarse silicon carbide powder and FP is the average grit size of the fine silicon carbide powder.

In other instances, the difference in grit sizes between the coarse silicon carbide powder and the fine silicon carbide powder can be at least about 15%, such as at least about 20%, at least about 25%, at least about 30%, at least about 35%, at least about 40%, at least about 45%, or even at least about 50%. In particular instances, the coarse powder can have an average grit size that is greater than the average grit size of the fine powder within a range between about 10% and about 500%, such as between about 15% and about 400%, between about 20% and about 300%, or even between about 30% and about 200%.

In particular instances, the fine silicon carbide powder can have an average grit size that is not greater than about 20 microns. In other examples, the fine silicon carbide powder can have an average grit size that is less than 20 microns, such as not greater than about 15 microns, not greater than about 10 microns, not greater than about 8 microns, or even not greater than about 5 microns. For particular mixtures, the fine silicon carbide powder can have an average grit size that is at least about 0.1 microns, at least about 0.3 microns, at least about 0.5 microns, or even at least about 0.8 microns. It will be appreciated that the fine silicon carbide powder can have an average grit size within a range between any of the minimum values and maximum values listed above.

In one specific embodiment, the coarse silicon carbide powder can have an average grit size that is at least about 200 microns. In other cases, the coarse silicon carbide powder can have an average grit size of at least about 250 microns, at least about 300 microns, at least about 400 microns, at least about 500 microns, or at least about 600 microns. In particular instances, the coarse silicon carbide powder can have an average grit size that is not greater than about 5000 microns, such as not greater than about 2500 microns, or even not greater than about 1500 microns. It will be appreciated that the coarse silicon carbide powder can have an average grit size within a range between any of the minimum values and maximum values listed above.

In certain instances, the mixture can include additional grit sizes of powder materials, such as silicon carbide powder, such that the mixture can be a trimodal grit size distribution. For example, such a mixture can include a fine silicon carbide powder, a coarse silicon carbide powder, and an intermediate silicon carbide powder, wherein the intermediate powder has an average grit size between the average grit size of the fine powder and the average grit size of the coarse powder. In particular instances, the coarse silicon carbide powder can have an average grit size that is at least about 5% greater than the average grit size of the intermediate silicon carbide powder, based on the intermediate powder grit size. The percentage difference in grit size can be calculated by the equation $((CP-IP)/IP)\times100\%$, wherein CP is the average grit size of the coarse silicon carbide powder and IF is the average grit size of the intermediate silicon carbide powder.

In other instances, the difference between the average grit size of the coarse powder and average grit size of the intermediate silicon carbide powder can be greater, such as at least about 8%, at least about 10%, at least about 12%, at least about 15%, at least about 20%, at least about 30%, or even at least about 40%. In particular instances, the difference in grit size between the coarse powder and the intermediate powder can be within a range between about 5% and about 100%, such as between about 10% and 100%.

Additionally, the intermediate silicon carbide powder can have an average grit size that is at least about 5% larger than the average grit size of the fine silicon carbide powder, based on the average grit size of the fine powder. The percentage difference in grit size can be calculated by the equation $((IP-FP)/FP)\times100\%$, wherein IP is the average grit size of the intermediate silicon carbide powder and FP is the average grit size of the fine silicon carbide powder. Notably, the percent difference in average grit size between the intermediate powder and the fine powder can be the same as the difference between the coarse powder and the intermediate powder, as noted in embodiments herein.

In particular instances, the intermediate powder can have an average grit size of at least about 40 microns. In other embodiments, the average grit size of the intermediate silicon carbide powder can be greater, such as at least about 50 microns, at least about 60 microns, at least about 80 microns, or even at least about 90 microns. Certain intermediate silicon carbide powders can have an average grit size that is not greater than about 200 microns, such as not greater than about 175 microns, not greater than about 150 microns, not greater than about 125 microns, or even not greater than about 100 microns. It will be appreciated that the intermediate silicon carbide powder can have an average grit size within a range between any of the minimum values and maximum values provided above.

After forming the mixture at step 101, the process can continue at step 103, which includes forming the mixture into a green article. In accordance with one embodiment, the shaping process can include a slip casting process wherein the slurry can be shaped into a body in a gypsum mold. Notably, the slurry can be poured into a plaster (gypsum) mold for casting, wherein the water within the slurry is drawn by capillary action through the gypsum mold, leaving behind a cast product, which is a green article. The green article is an unfinished, unsintered ceramic part. For further details of the techniques for forming the ceramic body, attention is drawn to U.S. Pat. No. 4,990,469, incorporated herein by reference. While slip casting is described, other ceramic processing techniques can be used. For example, drip casting, pressing, pressure casting, extrusion, molding, and other techniques.

After forming the mixture into a green article at step 103, the process can continue by firing the green article to form a recrystallized article at step 105. Generally, during firing, the green body is heated to a sublimation temperature for a time period of at least 2 hours, and more particularly, between about 2 to about 20 hours, depending upon the size of the body and the thickness of the wall of the body.

By firing the body to a sublimation temperature, the finer particles contained within the original mixture can be turned to a gas phase component, which then preferentially recombine with the coarse silicon carbide particles within the body to form larger particles through a sublimation/recrystallization reaction. Particular firing processes may utilize a sublimation temperature of at least about 1700° C. In other processes, the sublimation temperature can be at least about 1750° C., at least about 1800° C., at least about 1900° C., or even at least about 2000° C. Embodiments herein can utilize a sublimation temperature within a range between about 1700° C. and about 2500° C., between about 1750° C. and about 2450° C. or even between about 2000° C. and about 2450° C.

During firing, the atmosphere within the chamber can include an inert gas. In particular, at least a majority of the atmosphere can be composed of an inert gas, and more particularly, the entire atmosphere can consist of an inert gas, such as a noble gas. For example, the atmosphere during heating can consist essentially of argon. Alternatively, a reducing atmosphere may be suitable during heating. In one embodiment, the reducing atmosphere may include a nitrogen-containing atmosphere, such as a nitrogen-rich atmosphere containing greater than 50% by volume nitrogen for the total volume of the chamber.

After forming the recrystallized article at step 105, the process can continue at an optional step 107 that comprises shaping the recrystallized article. The shaping process may include removal of particular portions of the body of the recrystallized article to give it a particular shape or contour for a desired application. Various methods can be undertaken to shape the fired article, including, for example, sand blasting, grinding, and other such techniques for forming of the article.

The process can continue at step 111 by finishing the recrystallized body. Particularly suitable methods of finishing can include grinding and/or polishing procedures. The finishing processes may smooth the surfaces of the article to a finer finish. Finishing may facilitate forming a composite body with particular sizes and contours as desired by the industry.

After finishing the recrystallized body at step 111, the process can continue at step 113, which includes infiltrating the recrystallized body to form a composite body. In particular, the infiltration process can include placing an infiltrant material in direct contact with the recrystallized body. Moreover, infiltrating may include a heat treatment while the infiltrant is in direct contact with the recrystallized body. In particular, infiltrating may include heating the processing chamber to a melting point of the infiltrant material to facilitate a phase change of the infiltrant from solid to liquid, facilitating flow of the infiltrant into the recrystallized body. Notably, the infiltration process can utilize capillary action, wherein the pores of the recrystallized silicon carbide body have suitable features including surface tension characteristics between the recrystallized body and the infiltrant, thereby enabling penetration of the infiltrant into the pores of the recrystallized body through capillary action.

The recrystallized body can be formed to have a particular type of porosity that facilitates effective and thorough infiltration of the infiltrant throughout the entire volume of the recrystallized silicon carbide body. For example, the recrystallized body can be characterized by a high degree of interconnected porosity defining a continuous phase extending throughout the volume of the body in the form of channels that are connected to each other. The interconnected porosity can exist as an interconnected network of pores that can be filled or infiltrated with the infiltrant. In accordance with an embodiment, at least about 50% of the total amount of porosity within the recrystallized body can be interconnected porosity. In other instances, the amount of interconnected porosity can be greater, such as at least about 60%, at least about 70%, at least about 80%, at least about 85%, at least about 90%, at least about 95%, or even at least about 98% of the total amount of porosity can be interconnected porosity. In one embodiment, essentially all of the porosity within the recrystallized silicon carbide body is interconnected porosity.

Moreover, the porosity of the recrystallized body can be a bimodal distribution of porosity including fine pores and coarse pores, wherein the fine pores have a fine average pore size that is significantly less than the coarse average pore size. According to one embodiment, the coarse average pore size can be at least about 10% larger than the fine average pore size, wherein the percentage is based upon the size of the coarse average pore size, and calculated by the equation $((Pc-Pf)/Pc)\times 100\%$, wherein Pc is the coarse average pore size and Pf is the fine average pore size. Notably, a bimodal pore size distribution is characterized by a distribution of pore sizes that exhibits two clear and measureable modes of pore sizes, fine pores having a fine average pore size that is significantly less than coarse pores having a coarse average pore size. In particular instances, the coarse average pore size can be at least about 20%, at least about 30%, at least about 40%, at least about 50%, at least about 60%, at least about 70%, at least about 80%, or even at least about 100% greater than the fine average pore size. In other instances, the coarse pore size can be within a range between about 10% and about 500%, such as between about 30% and about 400%, between about 50% and about 400%, between about 80% and about 300%, or even between about 100% and about 300% greater than the fine average pore size. The body may have a greater percentage of coarse pores than fine pores.

It will be appreciated that the recrystallized body can have a multimodal pore size distribution, wherein there are greater than simply two modes (i.e., a bimodal distribution) and there may be three or more modes of pore sizes. For example, the recrystallized body can have a trimodal or quadramodal distribution of pore sizes.

According to a particular embodiment, the article can have an average pore size, which is a measure of the average size of the pores within the recrystallized body prior to being filled with the infiltrant of at least about 1 micron. In other embodiments, the average pore size of the recrystallize body can be greater, such as at least about 3 microns, at least about 5 microns, at least about 10 microns, or even at least about 14 microns. Still, in one non-limiting embodiment, the body can have an average pore size of not greater than about 200 microns, such as not greater than about 150 microns, not greater than about 100 microns, not greater than about 60 microns, or even not greater than about 30 microns. It will be appreciated that the average pore size can be within a range between the minimum and maximum pore sizes noted above. Pore size measurements can be made using Hg porosimetry, which can represent the necks of pores that make up the interconnected porosity.

A majority of the pores of the recrystallized body can be filled within an infiltrant. In particular embodiments, essentially all of the pores having an average pore size of 200 microns or greater can be filled with the infiltrant. Moreover, a significant portion, such as at least about 50%, at least about 75%, or even at least about 80% of the pores having a size of 50 microns or greater can be filled with the infiltrant. In one non-limiting embodiment, some pores, particularly a minor amount of pores within the body, having an average pore size of less than about 50 microns, may not necessarily contain the infiltrant. Such pores may be isolated or closed porosity that may not necessarily be part of the interconnected porosity or network of connected pores within the recrystallized body.

In accordance with a particular embodiment, the infiltrating process can include heating of the recrystallized silicon carbide body and the infiltrant to an infiltration temperature of at least about 1200° C. In other embodiments, the infiltration temperature can be greater, such as at least about 1300° C., at least about 1400° C., at least about 1500° C., or even at least about 1700° C. In particular instances, the infiltration process can be conducted at an infiltration temperature within a range between about 1200° C. and about 2500° C., such as between about 1500° C. and about 2400° C., or even between about 1700° C. and about 2300° C.

The infiltration process can be conducted for an infiltration duration, which is a measure of the time at which the recrystallized body and infiltrant material are held at the infiltration temperature. The infiltration duration can ensure proper infiltration of the infiltrant throughout the entire volume of the recrystallized body. In accordance with an embodiment, the infiltration duration can be at least about 15 minutes. In other instances, the infiltration duration can be at least about 20 minutes, such as at least about 40 minutes, at least about an hour, or even at least about 2 hours. In particular instances, the infiltration duration is within a range between about 15 minutes and about 12 hours, such as between about 1 hour and 5 hours, or even between about 1 hour and 2 hours.

The infiltration process may be conducted in a particular atmosphere. For example, the atmosphere during infiltration can be a reducing atmosphere. In other instances it may be an inert atmosphere. In still other instances, the atmosphere can be controlled to be a combination of inert and reducing atmospheres at particular intervals during infiltration. For example, in one instance, during a first phase of infiltration, such as at a first select temperature of below about 600° C. or even at temperatures of below about 575° C., the atmosphere can include an inert gas. The first select temperature may be selected based upon the melting temperature of the infiltrant material. Suitable inert gases can include noble gases, such as argon.

After the first phase, and after heating the chamber to a temperature above the first select temperature, the atmosphere may optionally be altered. For example, a second gas species may be introduced in a second phase at a second select temperature above about 575° C., or above about 600° C. The second gas species can be flowed into the chamber to combine or completely replace the first gas species introduced in the first phase. One suitable gas for the second phase can include nitrogen, and during the second phase, the atmosphere may consist essentially of nitrogen. Alternatively, the gas may be altered from nitrogen in a first stage to argon in a second stage. It will be appreciated that the same gas may be used throughout the infiltration process.

During infiltration, the gas species of the first and/or second phases can be flowed through the infiltration chamber at a particular flow rate. Such a flow rate may ensure that a certain volume of gas is exchanged within the processing chamber and proper infiltration of the recrystallized silicon carbide body is achieved. In one embodiment, the flow rate of the gas during infiltration can be at a rate of not less than about 2 standard liters per minute (SLPM) for a chamber having a volume of 1.25 $m^3$. In other instances, the flow rate may be greater, such as not less than about 2.5 SLPM, not less than about 3 SLPM, not less than about 4 SLPM, or even not less than about 5 SLPM. Still, the flow rate may be not greater than about 25 SLPM, not greater than about 20 SLPM, not greater than about 18 SLPM, or even not greater than about 15 SLPM. Moreover, the flow rate used during first and/or second phases of infiltration may be within a range between any of the minimum or maximum values noted herein.

Moreover, in certain operations, the infiltration process can be a pressure-less infiltration process. For example, the infiltrant may not necessarily be pressed into the recrystallized silicon carbide body. In fact, the infiltration process may be an atmospheric gravitational infiltration process, wherein the pressure of the atmosphere within the infiltration chamber is about atmospheric pressure and infiltration is based upon the use of gravity and capillary action to draw the infiltrant into the recrystallized silicon carbide body. Certain processes may utilize a ram or other device to assist infiltration. And in still other instances, the pressure can be greater or less than atmospheric pressure within the infiltration chamber.

The infiltrant material can include silicon. In particular instances, the infiltrant can consist essentially of silicon. For example, the infiltrant can comprise at least about 98% silicon, such as at least about 99% silicon, at least about 99.9% silicon, at least about 99.99% silicon. Still, in at least one non-limiting embodiment, the infiltrant can be not greater than about 99.999% silicon. In one particular embodiment, the infiltrant comprises between about 98-99.9% silicon, not greater than about 0.75% aluminum, between about 0.001% and about 1.5% iron, between about 0.001% and 0.1% calcium, between about 0.001 and 0.5% manganese, between about 0.01 and about 0.5% oxygen, and less than about 0.1% other elements, wherein the percentage of components does not exceed 100%.

In one instance, the infiltrant can include a limited content of a particular impurity material. For example, the infiltrant can include not greater than about 3 wt % of an impurity material for the total weight of the infiltrant material. In other embodiments, the infiltrant can include not greater than about 2 wt %, such as not greater than about 1 wt %, not greater than about 0.8 wt %, not greater than about 0.5 wt %, or even not greater than about 0.1 wt % of an impurity material. Still, in one non-limiting embodiment, the infiltrant may have some content of an impurity material, such as at least about 0.001 wt %, at least about 0.01 wt %, at least about 0.05 wt %, or even at least about 0.1 wt % for the total weight of the body. It will be appreciated that the amount of an impurity material in the body can be within a range between any of the minimum and maximum percentages noted above. It will be appreciated that the above percentages may also represent the total content of any impurity materials in the infiltrant.

Exemplary impurity materials can include materials from the group of aluminum (Al), transition metal elements such as, nickel (Ni), chrome (Cr), magnesium (Mg), molybdenum (Mo), alkali elements, alkaline earth elements, intermetallics, and a combination thereof.

Additionally, the infiltrant can have a particular toughness. For example, the infiltrant can have a $K_{1c}$ fracture toughness, as measured according to ASTM standard E399 of not greater than about 2 MPa $m^{1/2}$. In still other instances, the fracture toughness can be lower, such as not greater than about 1.8 MPa $m^{1/2}$, not greater than about 1.5 MPa $m^{1/2}$, not greater than about 1.3 MPa $m^{1/2}$, or even not greater than about 1 MPa $m^{1/2}$. In one non-limiting embodiment, the infiltrant may have a fracture toughness of at least about 0.1 MPa $m^{1/2}$. It will be appreciated that the fracture toughness of the infiltrant can be within a range between any of the minimum and maximum values noted above.

In other embodiments, the infiltrant can be a material having a density of at least about 2.0 g/$cm^3$. In other embodiments, the density can be greater, such that it is at least about 2.1 g/$cm^3$, such as at least about 2.2 g/$cm^3$, or even at least about 2.3 g/$cm^3$. In particular instances, the infiltrant can have a density of not greater than about 3.5 g/$cm^3$, such as not greater than about 3 g/$cm^3$, not greater than about 2.8 g/$cm^3$, or even not greater than about 2.6 g/$cm^3$. It will be appreciated that the infiltrant can have a density within a range between any of the minimum and maximum values noted above.

Upon completing the infiltration process, a composite body is formed that can include a first phase defined by the structure of the recrystallized silicon carbide body and a second phase comprising the infiltrant. The first phase can define a first interconnected network of material. Additionally, the second phase can define a substantially interconnected network of material extending through the continuous network of recrystallized silicon carbide. As such, the composite body can be defined by two distinct phases that are both interconnected phases, a first phase of silicon carbide and a second phase of the infiltrant. In particular instances, the first phase can consist essentially of silicon carbide. Moreover, in one embodiment, the second phase can consist essentially of the infiltrant.

In accordance with one embodiment, the composite body can be a silicon-carbide-based composite, such that the majority of the body, as measured in vol %, comprises silicon carbide. In particular embodiments, the composite body can include at least 63 vol % silicon carbide for the total volume of the body. In other instances, the amount of silicon carbide can be greater, such as at least about 70 vol %, at least about 73 vol %, at least about 75 vol %, at least about 77 vol %, or even at least about 80 vol %. In one non-limiting embodiment, the composite body can include not greater than about 95 vol % silicon carbide, such as not greater than about 90 vol %, not greater than about 88 vol %, or even not greater than about 85 vol %. It will be appreciated that the amount of silicon carbide within the composite body can be within a range between any of the minimum values and maximum values noted above.

According to another embodiment, the composite body can be formed such that it contains at least 5 vol % infiltrant for the total volume of the body. In other instances, the composite body can contain at least about 8 vol %, at least about 10 vol %, at least about 12 vol %, at least about 15 vol %, at least about 18 vol %, or even at least about 20 vol % infiltrant for the total volume of the body. According to other embodiments, the composite body can be formed such that it contains not greater than about 30 vol % infiltrant. Particular composite bodies may contain less infiltrant, such as not greater than about 28 vol %, not greater than about 25 vol %, or not greater than about 22 vol %, infiltrant for the total volume of the composite body. It will be appreciated that the total amount of infiltrant within the body can be within a range between any of the minimum values and maximum values noted above.

The recrystallized silicon carbide portion of the composite body may be characterized by a particular morphology. The recrystallized silicon carbide body can have a first phase comprising large grains of silicon carbide, which may facilitate certain properties. In accordance with an embodiment, the first phase comprising the silicon carbide grains can have an average grain size of at least about 200 microns. In fact, the first phase can have an average grain size of at least about 250 microns, at least about 300 microns, at least about 400 microns, at least about 500 microns, at least about 600 microns, or even at least about 800 microns. In one non-limiting embodiment, the first phase can include silicon carbide having an average grain size that is not greater than about 5000 microns, such as not greater than about 2500 microns, not greater than about 1500 microns, not greater than about 1200 microns, not greater than about 1000 microns, such as not greater than about 900 microns, not greater than about 800 microns, not greater than about 700 microns, not greater than about 600 microns, or even not greater than about 500 microns. It will be appreciated that the average grain size of the first phase can be within a range between any of the minimum values and maximum values listed above.

The composite article may have a particular content of porosity. For example, the body of the composite article may include not greater than about 10 vol % porosity for the total volume of the body. In other examples, the content of porosity may be less, such as not greater than about 8 vol %, not greater than about 6 vol %, not greater than about 4 vol %, not greater than about 2 vol %, or even not greater than about 1 vol %. Still, in other non-limiting embodiments, the porosity can be at least about 0.05 vol %, such as at least about 0.5 vol %, at least about 1 vol %, or even at least about 2 vol %. It will be appreciated that the body can have a porosity within a range between any of the minimum and maximum percentages noted above.

The composite body may be formed to have a particular density. For example, the density of the body can be at least about 2.2 g/cm$^3$, such as at least about 2.4 g/cm$^3$, at least about 2.6 g/cm$^3$, or even at least about 2.9 g/cm$^3$. Still, in another instances, the body can have a density of not greater than about 3.5 g/cm$^3$, such as not greater than about 3.3 g/cm$^3$, or even not greater than about 3.2 g/cm$^3$.

In other instances, the composite body described according to embodiments herein can have a particular flexural strength as measured according to a bend test under ASTM 1161, wherein at least 5 samples, having an average width of approximately 5.9 mm and an average depth of approximately 4.0 mm, are tested and the results are averaged. For example, the composite body can have a flexural strength of not greater than about 160 MPa, such as not greater than about 150 MPa, such as not greater than about 140 MPa, not greater than about 120 MPa, not greater than about 100 MPa, not greater than about 90 MPa, not greater than about 80 MPa, not greater than about 70 MPa, or even not greater than about 68 MPa. In still other instances, the body of the composite article can have a flexural strength of at least about 5 MPa, such as at least about 10 MPa, at least about 20 MPa, at least about 30 MPa, at least about 40 MPa, at least about 45 MPa, or even at least about 50 MPa. It will be appreciated that the flexural strength of the composite body may be expressed as a value within a range between any of the minimum values and maximum values noted above.

Additionally, the body of the composite article may have a particular corrosion resistance. For example, the oxidation resistance, as measured via exposure to one or more select chemical reagents such as 98% $H_2SO_4$, 50% NaOH, 53% HF, 85% $H_3PO_4$, 70% $HNO_3$, 45% KOH, 25% HCl, and a combination thereof (e.g., 10% HF and 57% $NHO_3$). Corrosion resistance can be measured by submerging a sample of the material in a bath containing the particular concentration of the reagent for 125 to 300 hours while continuously stirring and measuring the loss of material. Notably, the composite of embodiments herein can have a corrosion resistance that is significantly greater than other materials and composites. For example, the body can have a corrosion resistance relative to 98% $H_2SO_4$ of not greater than about 55 mg/cm$^2$yr, such as not greater than about 53 mg/cm$^2$yr, or even not greater than about 50 mg/cm$^2$yr.

Other exemplary composites herein can have a corrosion resistance relative to 50% NaOH of not greater than about 1000 mg/cm$^2$yr, such as not greater than about 950 mg/cm$^2$yr, or even not greater than about 900 mg/cm$^2$yr.

In another embodiment, the composite body can have a corrosion resistance relative to 53% HF of not greater than about 7 mg/cm$^2$yr, such as not greater than about 6 mg/cm$^2$yr, or even not greater than about 5 mg/cm$^2$yr.

In still another embodiment, the composite body can have a corrosion resistance relative to 85% $H_3PO_4$, of not greater than about 8 mg/cm$^2$yr, such as not greater than about 7 mg/cm$^2$yr, or even not greater than about 6 mg/cm$^2$yr.

According to one embodiment, the composite body can have a corrosion resistance relative to 70% $HNO_3$ of not greater than about 0.5 mg/cm$^2$yr, such as not greater than about 0.2 mg/cm$^2$yr, or even not greater than about 0.1 mg/cm$^2$yr.

For yet another embodiment, the composite body can have a corrosion resistance relative to 45% KOH of not greater than about 1000 mg/cm$^2$yr, such as not greater than about 950 mg/cm$^2$yr, or even not greater than about 900 mg/cm$^2$yr.

In particular instance, the composite body can have a corrosion resistance relative to 25% HCl, of not greater than about 0.9 mg/cm$^2$yr, such as not greater than about 0.6 mg/cm$^2$yr, or even not greater than about 0.2 mg/cm$^2$yr.

For yet another embodiment, the composite body can have a corrosion resistance relative to 10% HF and 57% $NHO_3$ of not greater than about 1000 mg/cm$^2$yr, such as not greater than about 950 mg/cm$^2$yr, or even not greater than about 900 mg/cm$^2$yr.

Furthermore, the composite body of exemplary embodiments herein can have an improved wear resistance over other recrystallized silicon carbide materials and composite bodies. For example, the composite body can have a wear rate of not greater than about 0.2 mm$^3$/g. The wear rate is measured according to ASTM G76-07 Standard Test Method for Conducting Erosion Tests by Solid Particle Impingement Using Gas Jets. Still, the wear rate of the composite body may be at least about 0.01 mm$^3$/g, such as at least about 0.05 mm$^3$/g. It will be appreciated that the wear rate of the body may be expressed as a value within a range between any of the minimum values and maximum values noted above.

In particular instances, the body of the composite article can have a particular content of an impurity material. For example, the body of the composite article can have not greater than about 3 wt % of an impurity material for the total weight of the body. In still other instances, the total weight of an impurity material can be less, such as not greater than about 2 wt %, not greater than about 1 wt %, not greater than about 0.5 wt % or even not greater than about 0.1 wt %. Still, in one non-limiting embodiment, the body may have a content of an impurity material, such as at least about 0.001 wt %, at least about 0.01 wt %, at least about 0.05 wt %, or even at least about 0.1 wt % for the total weight of the body. It will be appreciated that the amount of an impurity material in the body can be within a range between any of the minimum and maximum percentages noted above. It will further be appreciated that the above percentages may also represent the total content of any impurity materials in the entire body.

Impurity materials can be elements or compounds from the group of aluminum (Al), nickel (Ni), chrome (Cr), magnesium (Mg), molybdenum (Mo), alkali elements, alkaline earth elements, intermetallics, and a combination thereof. In particular instances, the body can be essentially free of one or all of the above noted impurity materials. For example, the body can be essentially free of aluminum (Al). Moreover, the body can be essentially free of nickel (Ni). In still other instances, the body can be essentially free of chrome (Cr). In yet another aspect, the body can be essentially free of magnesium (Mg). Additionally, the body can be essentially free of molybdenum (Mo).

The composite body may be formed to have a particular shape. For example, the composite body may have a polygonal cross-sectional shape, including but not limited to, a rectangular cross-sectional shape, a circular cross-sectional shape, a triangular cross-sectional shape, or the like. In other instances, due to the forming methods utilized in constructing the recrystallized silicon carbide body, the composite body may have a complex geometry. That is, the body may have a geometry that cannot be explained as a simple polygonal shape as viewed in cross-section.

For instance, in certain embodiments the composite body may be formed to have a shape including a length (L), a thickness (T), and a width (W) wherein the length can be greater than or equal to the width, and the width can be greater than or equal to the thickness. In particular instances, the length may be equal to the width, which may be equal to the thickness such that the composite body is generally a cube. Still, in other instances the length can be greater than the width, such as at least about 2 times greater, such as at least about 3 times greater, or even at least about 5 times greater than the width. Moreover, in other instances the width can be significantly greater than the thickness, such that it is at least 2 times greater, at least about 3 times greater, or even at least about 5 times greater than the thickness.

In other instances, the body can have a generally circular cross-sectional shape which may be defined by a diameter. The composite body can be in the form of a sphere, ellipse, or ellipsoid shape. Still in other instances, the composite body can be in the form of a disk or cylindrical shape. In such instances, the body has a diameter (D) and a thickness (T), wherein the diameter may be greater than or equal to the thickness. In accordance with one embodiment, the composite body can have a thickness of at least about 0.65 cm, such as at least about 0.7 cm, at least about 0.8 cm, or at least about 0.9 cm. In fact, in certain instances the body can have a thickness of at least about 1.50 cm.

Figure 2:
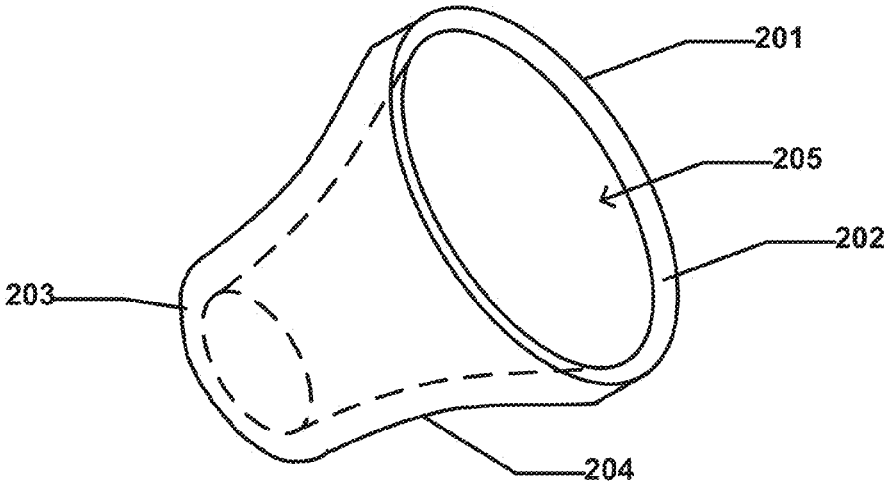
FIG. 2 includes an illustration of a pipe choke according to an embodiment.

FIG. 2 includes an illustration of an exemplary article according to an embodiment herein. As illustrated, the article can be a pipe choke having a body 201 including a first surface 202 and a second surface 203 that is spaced apart from the first surface 202 by a side surface 204. The body 201 can include the material of the composite bodies described herein. The side surface 204 can be a peripheral surface that can extend circumferentially around the periphery of the body 201. Additionally, the body 201 can include an opening extending through the entire volume of the body 201 and joining the first surface 202 and second surface 203. The opening 205 may facilitate flow of a liquid or other material through the body 201. It will be appreciated that while FIG. 2 illustrates a particular composite article in the form of a pipe choke, other devices may be formed of the composite material, including for example, impingement blocks, liners, nozzle heads, cyclones heads, and the like.

Figure 3:
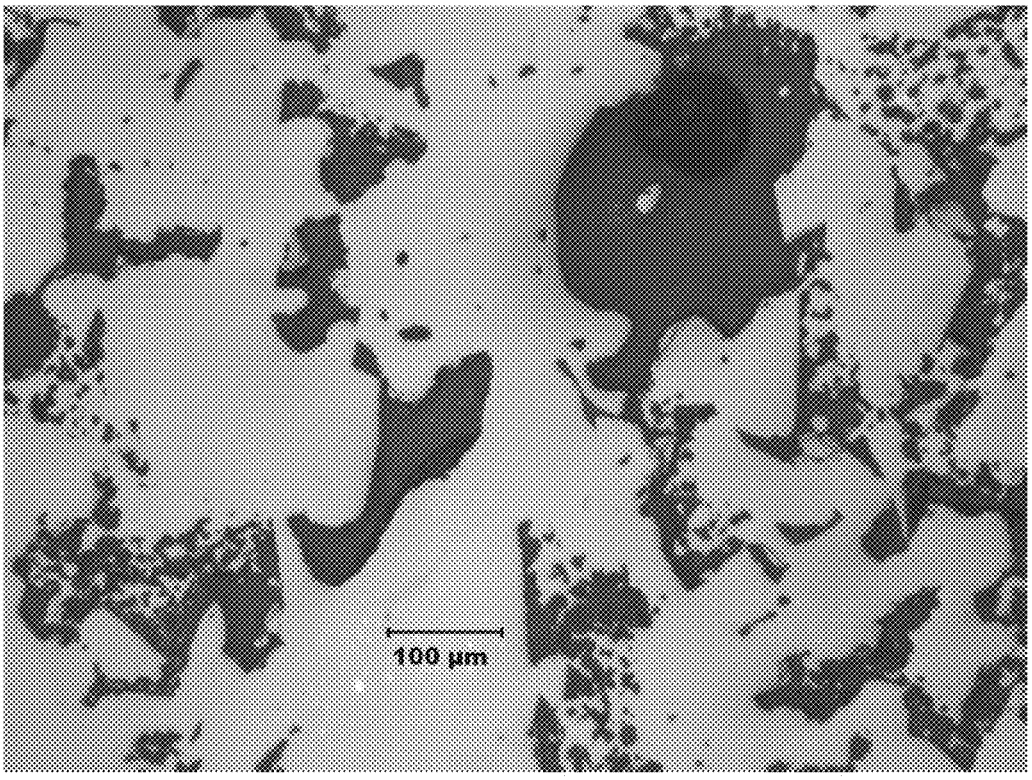
FIG. 3 includes an optical image of a cross-section of a composite article according to an embodiment.

FIG. 3 includes an optical image of cross-sections of the recrystallized body after infiltration.

Example

A sample (Sample 1) of an infiltrated, recrystallized silicon carbide body is created according to the following process. A mixture is created comprising silicon carbide powder of two different average particle sizes, 37 wt % of a fine silicon carbide powder having an average particle size of approximately 3 microns (commercially available as FCP07 powder from Saint-Gobain Corporation) and 56 wt % coarse silicon carbide powder having an average particle size of approximately 1000 microns (commercially available as 16f SiC powder from Saint-Gobain Corporation). The mixture further includes a liquid vehicle of deionized water for suspension of the silicon carbide powders to form a wet mixture. The mixture also includes 5-10% additives, including sodium hydroxide and sodium silicate.

After thoroughly mixing the mixture, sample bars are made of the material via slip casting. After casting, the bodies are removed and dried to form green bodies. After drying, each of the green bodies is fired to a temperature of approximately 2100° C. for a duration of about 2 hours in an argon atmosphere for recrystallization. The body of Sample 1 is infiltrated with an infiltrant made of 98-99.9% silicon, less than approximately 0.75% aluminum, 0.001%-1.5% iron, 0.001%-0.1% calcium, 0.001%-0.5% manganese, 0.01%-0.5% oxygen, and less than about 0.1% other elements, wherein the percentage of components does not exceed 100%. Infiltration includes heating at a first phase to a temperature around 600° C. in a argon atmosphere. Infiltration is continued by heating in a second phase to a temperature of approximately 2100° C. in the same argon atmosphere until infiltration is completed. The composite body formed from infiltration of the recrystallized silicon carbide body is then cooled. The average room temperature MOR is 59.2 MPa and the average wear is approximately 0.1 $mm^3/g$.

The embodiments herein are directed to a composite article for use as various products in construction industries and the like. The composite articles herein include recrystallized silicon carbide bodies and an infiltrant dispersed throughout the recrystallized silicon carbide body. Notably, the present articles utilize a combination of features, including but not limited to, particular materials, such as infiltrant compositions, silicon carbide materials, morphology of the composite article, mechanical properties, and certain measurable characteristics that represent a departure from the state-of-the-art.

Silicon carbide bodies have been utilized in various prior art structures. Generally, however, such materials have been limited to pure recrystallized silicon carbide, or recrystallized silicon carbide bodies having a surface layer of material. The surface layer of material is not an infiltrant because it does not penetrate the full volume of the body, and also does not form a continuous phase of material extending through the silicon carbide body. Others have made attempts to infiltrate silicon carbide bodies with certain materials, particularly intermetallic compositions. (See, for example, "Melt Infiltration of Selected Intermetallics into SiC", by Rawers et al., U.S. Dept. of the Int., Journal of Materials Science Letters 9, pages 503-505 (1990)).

The embodiments provide a combination of features, which can be combined in various manners to describe and define the bonded abrasive articles of the embodiments. The description is not intended to set forth a hierarchy of features, but different features that can be combined in one or more manners to define the invention. In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Thus, to the maximum extent allowed by law, the scope of the present invention is to be determined by the broadest permissible interpretation of the following claims and their equivalents, and shall not be restricted or limited by the foregoing detailed description.

The disclosure is submitted with the understanding that it will not be used to interpret or limit the scope or meaning of the claims. In addition, in the foregoing disclosure, various features may be grouped together or described in a single embodiment for the purpose of streamlining the disclosure. This disclosure is not to be interpreted as reflecting an intention that the embodiments herein limit the features provided in the claims, and moreover, any of the features described herein can be combined together to describe the inventive subject matter. Still, inventive subject matter may be directed to less than all features of any of the disclosed embodiments.

What is claimed is:

1. An article comprising:

a body including a first phase comprising recrystallized silicon carbide and a second phase comprising silicon, wherein the first phase comprises an average grain size greater than about 300 microns, and wherein the second phase defines an essentially continuous and interconnected network of material extending throughout the volume of the first phase.

2. The article of claim 1, wherein the body comprises a flexural strength of not greater than about 160 MPa according to ASTM 1161.

3. The article of claim 1, wherein the body comprises a wear rate not greater than about 0.2 $mm^3/g$ and at least about 0.05 $mm^3/g$ as measured according to ASTM G76-07 Standard Test Method for Conducting Erosion Test by Solid Particle Impingement Using Gas Jets.

4. The article of claim 1, wherein the secondary continuous phase comprises a material having a $K_{IC}$ toughness of at least about 0.1 MPa $m^{1/2}$ as measured according to ASTM standard E399.

5. The article of claim 1, wherein the first phase comprises an average grain size greater than about 400 microns.

6. The article of claim 1, wherein the second phase is an infiltrant and comprises silicon metal.

7. The article of claim 1, wherein the body comprises less than about 5 vol % organic material for the total volume of the body.

8. The article of claim 1, wherein the body comprises not greater than about 1% molybdenum (Mo).

9. The article of claim 1, wherein the body comprises at least about 63 vol % of the first phase for the total volume of the body.

10. The article of claim 1, wherein the body comprises at least about 5 vol % of the second phase for the total volume of the body.

11. The article of claim 1, wherein the first phase comprises an average grain size of at least about 500 microns.

12. The article of claim 1, wherein the body comprises a porosity of not greater than about 10 vol % for the total volume of the body.

13. The article of claim 1, wherein the body comprises a density of at least about 2.2 $g/cm^3$ and not greater than about 3 $g/cm^3$.

14. The article of claim 1, wherein the body comprises not greater than about 3 wt % of impurity materials for the total weight of the body, wherein the impurity materials are selected from the group consisting of aluminum (Al), nickel (Ni), chrome (Cr), magnesium (Mg), molybdenum (Mo), alkali elements, alkaline earth elements, intermetallics, and a combination thereof.

* * * * *